US009038937B2

(12) United States Patent
Riegner, III et al.

(10) Patent No.: US 9,038,937 B2
(45) Date of Patent: May 26, 2015

(54) SIZE-ADJUSTABLE AND SECURABLE MEDIA SPINDLE APPARATUS

(75) Inventors: Rudolf W. Riegner, III, Clinton, MD (US); Sin Yong Alvin Tay, Singapore (SG); Brian Flood, Waukesha, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 278 days.

(21) Appl. No.: 13/599,805

(22) Filed: Aug. 30, 2012

(65) Prior Publication Data

US 2014/0061359 A1 Mar. 6, 2014

(51) Int. Cl.
*B65H 75/24* (2006.01)

(52) U.S. Cl.
CPC .... *B65H 75/241* (2013.01); *B65H 2301/41368* (2013.01)

(58) Field of Classification Search
USPC ..... 242/578, 578.1, 608.4, 608.5, 609.2, 242/125, 598.4
See application file for complete search history.

(56) References Cited

U.S. PATENT DOCUMENTS

| | | | | | |
|---|---|---|---|---|---|
| 328,297 | A | * | 10/1885 | Dayton | 242/578.1 |
| 687,443 | A | * | 11/1901 | Succie | 242/578.1 |
| 862,109 | A | * | 7/1907 | Roth | 242/578.1 |
| 1,001,056 | A | * | 8/1911 | Lounsberry | 242/599.2 |
| 1,152,895 | A | * | 9/1915 | Keck | 242/578.1 |
| 1,544,145 | A | * | 6/1925 | Foothorap | 242/578 |
| 3,301,499 | A | * | 1/1967 | Ewing | 242/599.2 |
| 4,044,964 | A | | 8/1977 | Kellett | |
| 4,350,277 | A | * | 9/1982 | Anderson et al. | 226/190 |
| 4,378,095 | A | * | 3/1983 | Reynolds | 242/578.1 |
| 4,919,555 | A | | 4/1990 | Kikuchi | |
| 5,771,063 | A | | 6/1998 | Stephany et al. | |

OTHER PUBLICATIONS

Brady MiniMark Cartridge Video, specifically spindle arrangement shown between 0:22 and 1:00, http://www.en.bradyeurope.com/bradyeurope/downloads/downloadView.do/1904/MiniMark%20-%20New%20Cartridge%20Design%20Video.html.

* cited by examiner

*Primary Examiner* — William A Rivera
(74) *Attorney, Agent, or Firm* — Quarles & Brady LLP

(57) ABSTRACT

A media spindle apparatus for supporting a media roll having media to be delivered to a printing apparatus. The apparatus includes a spindle configured to support the roll. The spindle defines an axial direction about which the roll rotates relative to the printing apparatus to deliver the media to the printing apparatus. A guide member is supported by the spindle and guides the media to the printing apparatus. The guide member is positionable in a first configuration in which a securing mechanism is disengaged and the guide member is translatable substantially in the axial direction relative to the spindle. The guide member is pivotable about the axial direction relative to the spindle to move to a second configuration and thereby engage the securing mechanism to inhibit the guide member from translating in the axial direction relative to the spindle and pivoting from the second configuration to the first configuration.

18 Claims, 10 Drawing Sheets

SIZE-ADJUSTABLE AND SECURABLE MEDIA SPINDLE APPARATUS

CROSS-REFERENCE TO RELATED APPLICATION

Not applicable.

STATEMENT REGARDING FEDERALLY SPONSORED RESEARCH OR DEVELOPMENT

Not applicable.

FIELD OF THE INVENTION

The present disclosure generally relates to a spindle apparatus for supporting a media roll and delivering media from the roll to a printing apparatus. More particularly, the disclosure relates to a spindle apparatus that is appropriate for use with media rolls of different axial widths and inhibits reloading the apparatus after an initial media roll is exhausted.

BACKGROUND OF THE INVENTION

Replaceable media spindle devices are commonly used to deliver media (e.g., paper, adhesive labels supported by a releasable liner, and the like) to printing devices (e.g., ink-delivering printers, laser printers, and the like). Such spindle devices typically include a spindle that rotatably supports a media roll, and the media roll rotates relative to the printing device to unwind the roll and thereby deliver the media to the printing device. Next to each axial end of the media roll, the spindle typically supports a guide member that extends radially outwardly from the spindle. As the media roll rotates, media that is unwound from the roll engages the guide members, and the guide members thereby accurately guide the media toward the printing device. Without such guidance, print quality could suffer or media jams could occur.

Unfortunately, previous media spindle devices typically have one or more disadvantages. For example, the guide members are axially separated by a uniform distance for a specific type of spindle device. As such, a specific type of spindle device can only accommodate a media roll having a specific axial width. Manufacturers thus create many types of spindle devices that are each appropriate for a media roll having a specific width. Unfortunately, each type of spindle device may require different tooling (e.g., molding dies for forming spindles), which significantly increases manufacturing costs. Moreover, potential assembly and inventory confusion may occur if, besides having different widths, the different types of spindle devices otherwise have a similar appearance (e.g., are the same color, use guide members of similar sizes, or the like).

As another example, some media spindle devices are reloadable by a printing device user after the initial media roll is exhausted. In some cases, this functionality is provided by detachably connecting the guide members to the spindle. However, providing this functionality may be detrimental because it permits loading incompatible media types that could damage the printing device.

Thus, it would be desirable to have an improved media spindle that overcomes one or more of the above drawbacks.

SUMMARY OF THE INVENTION

In one aspect, the present invention provides a media spindle apparatus for supporting a media roll having media to be delivered to a printing apparatus. The media spindle apparatus includes a spindle configured to support the media roll. The spindle defines an axial direction about which the media roll is configured to rotate relative to the printing apparatus to deliver the media from the media roll to the printing apparatus. A guide member is supported by the spindle and configured to guide the media from the media roll to the printing apparatus. The guide member supports a securing mechanism. The guide member is positionable in a first configuration in which the securing mechanism is disengaged and the guide member is translatable substantially in the axial direction relative to the spindle. The guide member is pivotable about the axial direction relative to the spindle to move to a second configuration and thereby engage the securing mechanism to inhibit the guide member from translating in the axial direction relative to the spindle and pivoting from the second configuration to the first configuration.

In another aspect, the present invention provides a media spindle apparatus for supporting a media roll having media to be delivered to a printing apparatus. The media spindle apparatus includes a spindle configured to support the media roll. The spindle defines a longitudinal direction about which the media roll is configured to rotate relative to the printing apparatus to deliver the media from the media roll to the printing apparatus. A media guide is supported by the spindle and configured to guide the media from the media roll to the printing apparatus. The media guide is pivotable substantially about the longitudinal direction relative to the spindle to move from a first configuration to a second configuration. In the first configuration the media guide is translatable substantially in the longitudinal direction relative to the spindle. A securing mechanism connects the spindle and the media guide. When the media guide is disposed in the second configuration the securing mechanism inhibits the media guide from translating in the longitudinal direction relative to the spindle and inhibits the media guide from pivoting from the second configuration to the first configuration.

In yet another aspect, the present invention provides a media spindle apparatus for supporting a media roll having media to be delivered to a printing apparatus. The media spindle apparatus includes a spindle configured to support the media roll. The spindle defines a longitudinal direction about which the media roll is configured to rotate relative to the printing apparatus to deliver the media from the media roll to the printing apparatus. The spindle includes a first engagement surface having a first shape. A media guide is supported by the spindle and is configured to guide the media from the media roll to the printing apparatus. The media guide includes a second engagement surface having a second shape, and the second shape is an inverse shape of the first shape. The media guide also includes a securing arm. The media guide is pivotable substantially about the longitudinal direction relative to the spindle to move from a first configuration to a second configuration. In the first configuration the first engagement surface is disposed apart from the second engagement surface, the media guide is translatable substantially in the longitudinal direction relative to the spindle, and the securing arm is disengaged. In the second configuration the first engagement surface abuts the second engagement surface to inhibit the media guide from translating in the longitudinal direction relative to the spindle, and the securing arm engages the spindle to inhibit the media guide from pivoting to the first configuration.

The foregoing and advantages of the invention will appear from the following description. In the description, reference is made to the accompanying drawings which form a part hereof, and in which there is shown by way of illustration preferred embodiments of the invention. Such embodiments do not necessarily represent the full scope of the invention, however, and reference is made therefore to the claims herein for interpreting the scope of the invention.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
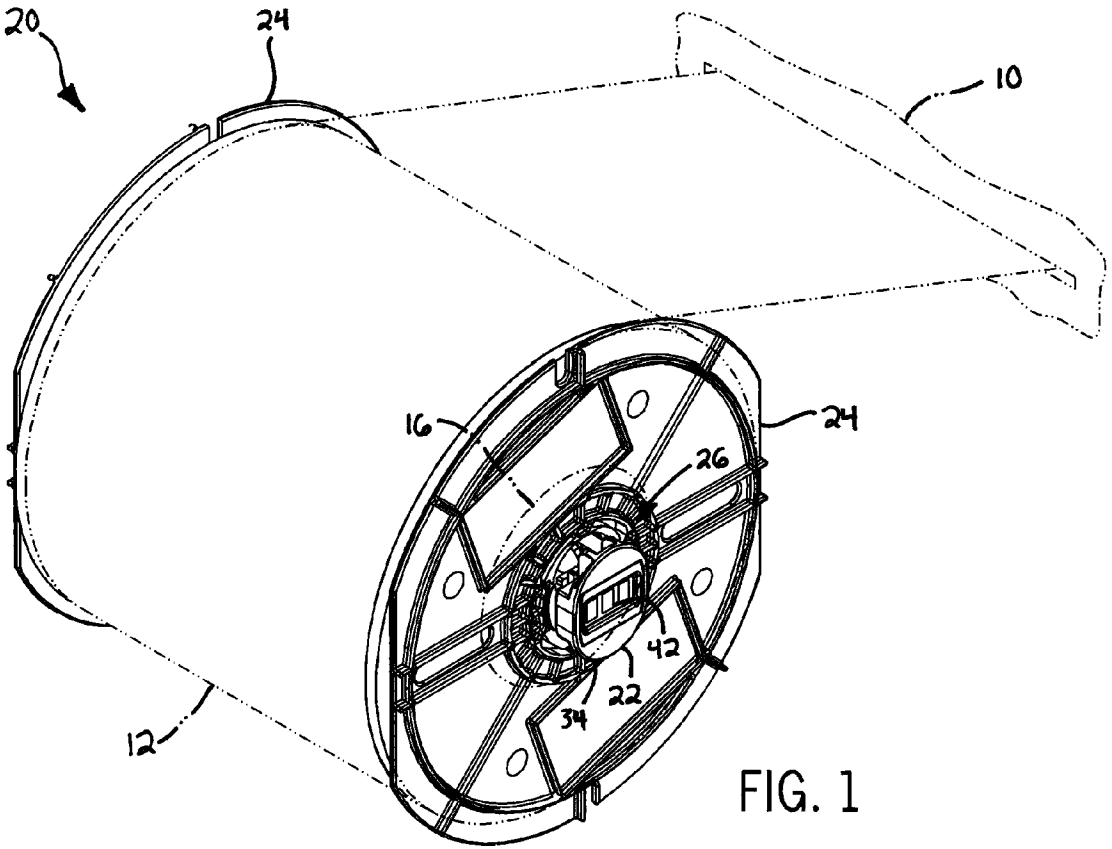
FIG. 1 is a perspective view of a media spindle apparatus according to the present invention supporting a media roll that delivers media to a printer apparatus.

Referring now to the figures and particularly FIGS. 1-4, the present invention provides a size-adjustable and securable media spindle apparatus 20. The spindle apparatus 20 generally includes a spindle 22 that is detachably supported relative to a printing apparatus 10. The spindle 22 supports a media roll 12 that rotates relative to the printing apparatus 10 to unwind and thereby deliver media to the printing apparatus 10. Longitudinally to the sides of the media roll 12, the spindle 22 supports media guides or "guide members" 24. The guide members 24 engage the media as the media unwinds from the roll 12 to accurately guide the media toward the printing apparatus 10.

Figure 3:
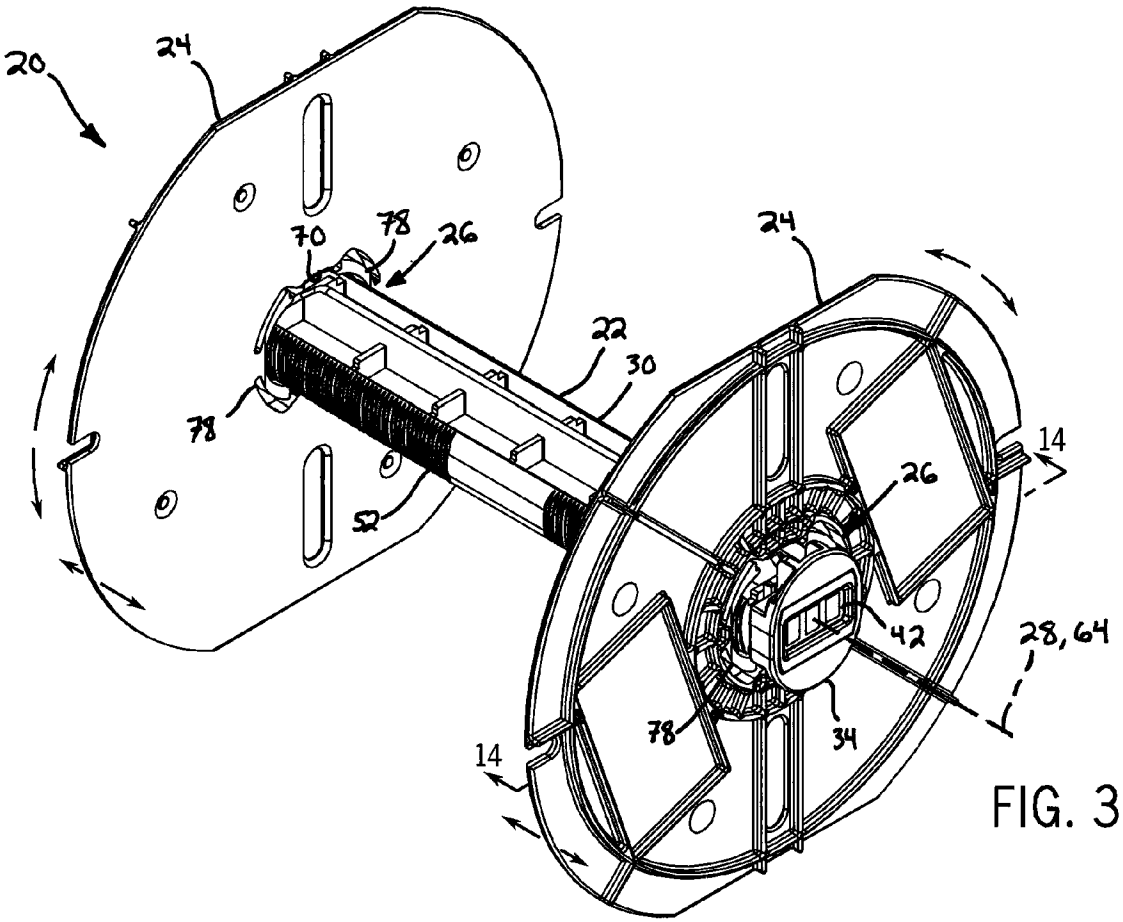
FIG. 3 is a perspective view of the media spindle apparatus of FIG. 1 with media guide members pivoted to a first or unlocked configuration.
Figure 4:
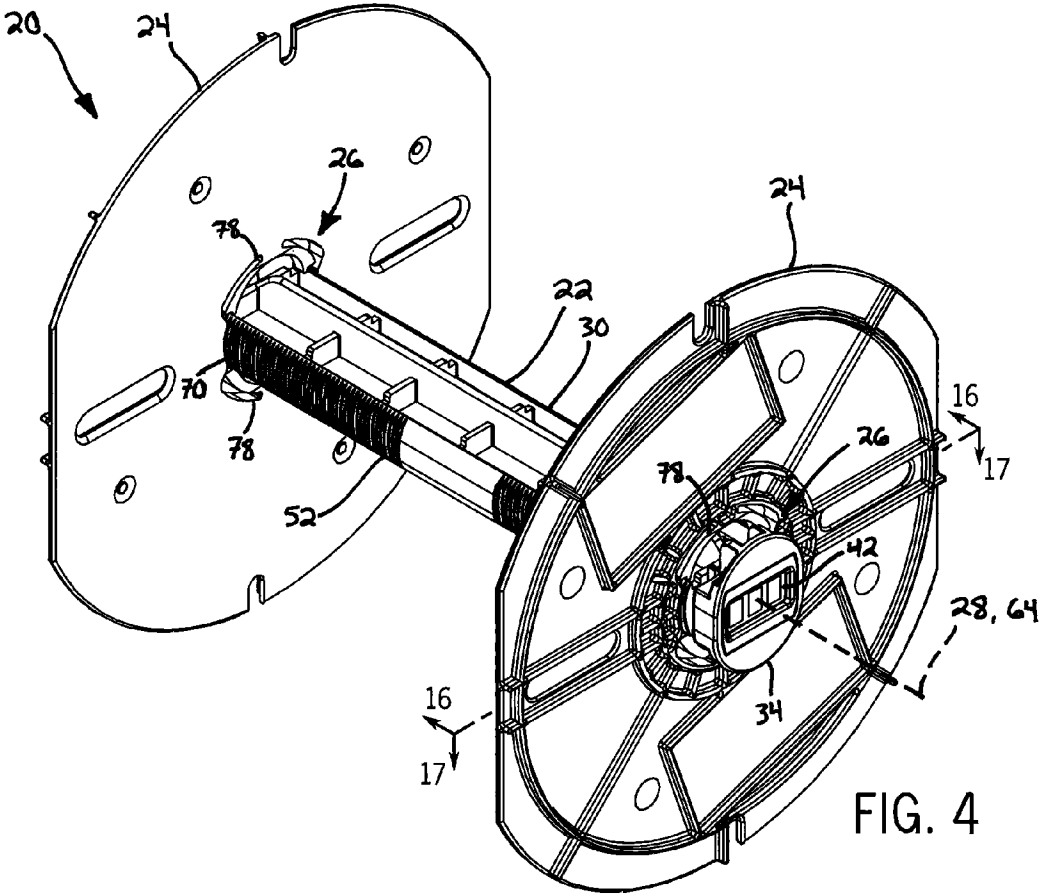
FIG. 4 is a perspective view of the media spindle apparatus of FIG. 1 with the media guide members pivoted to a second or locked configuration.
Figure 5:
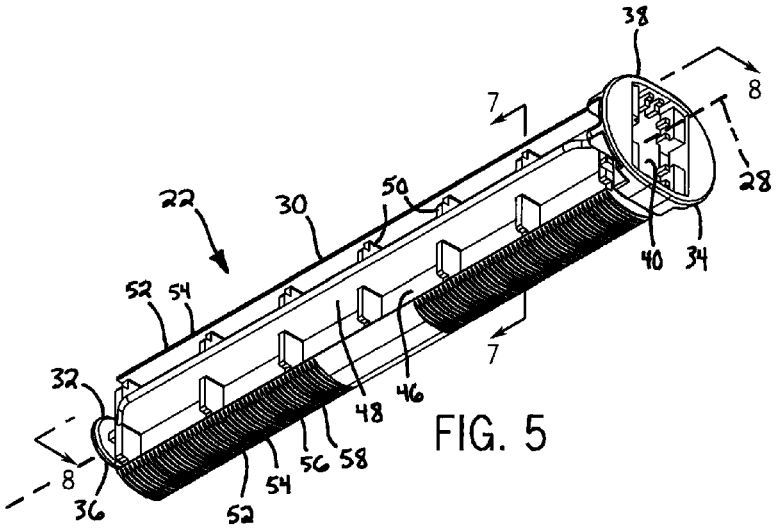
FIG. 5 is a perspective view of a spindle of the media spindle apparatus of FIG. 1.
Figure 6:
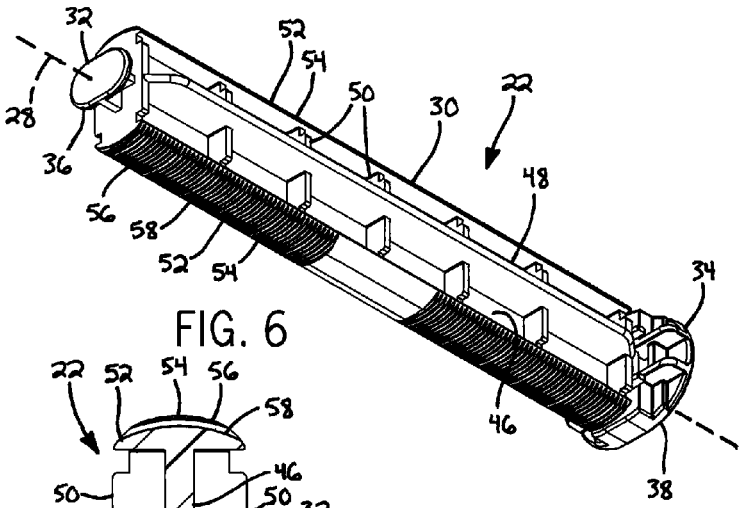
FIG. 6 is another perspective view of the spindle of FIG. 5.
Figure 7:
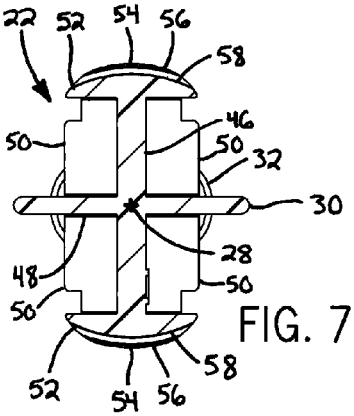
FIG. 7 is a cross-sectional view of the spindle along line 7-7 of FIG. 5.
Figure 8:
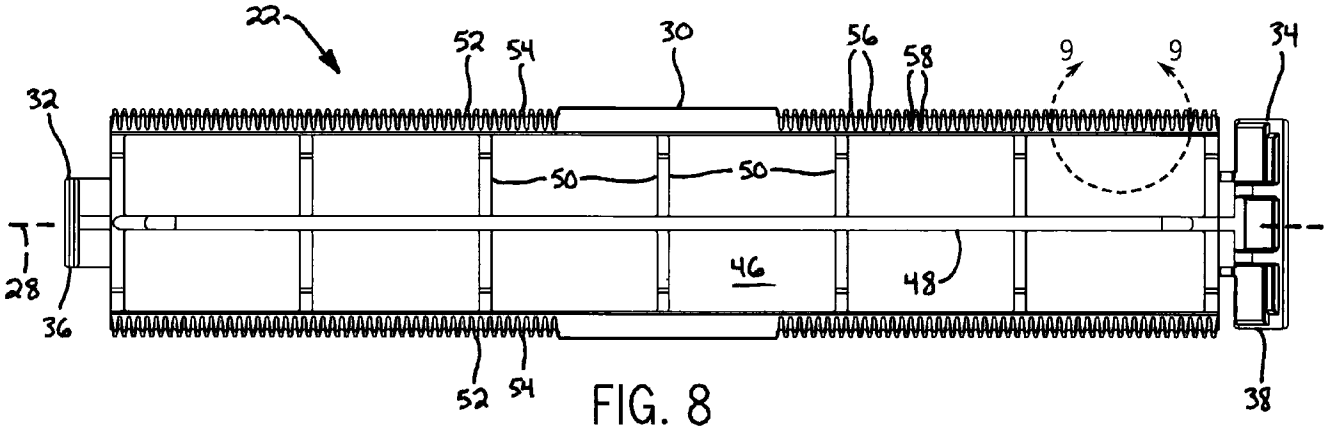
FIG. 8 is a longitudinal sectional view of the spindle along line 8-8 of FIG. 5.
Figure 9:
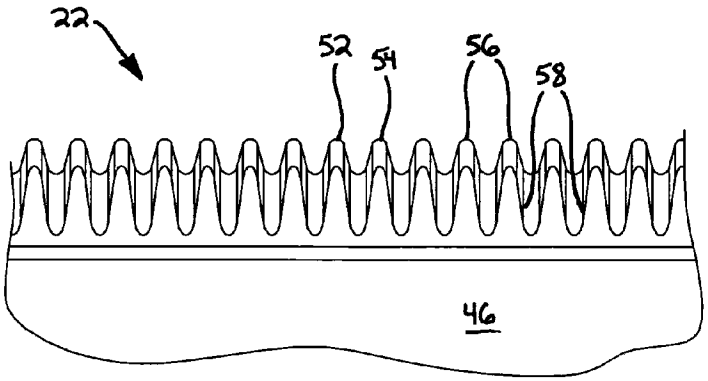
FIG. 9 is a detail view of the portion of the spindle enclosed by line 9-9 of FIG. 8.
Figure 10:
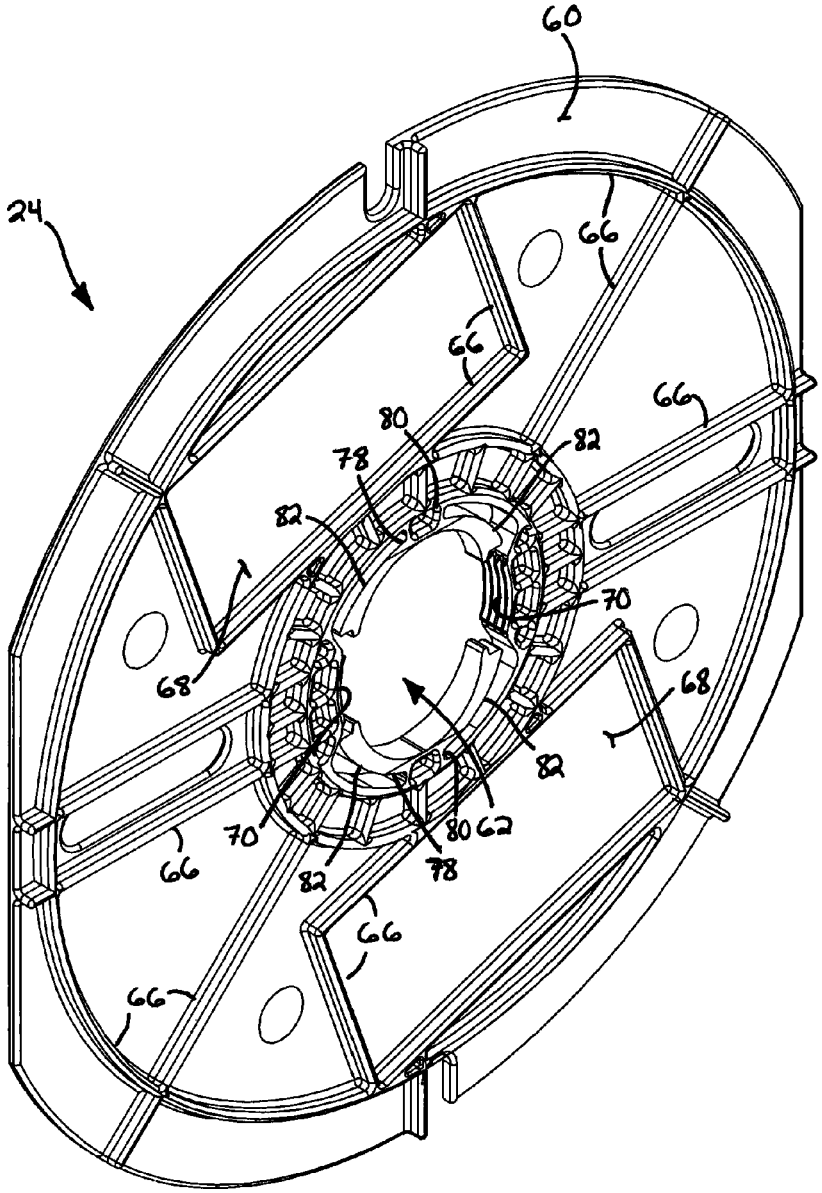
FIG. 10 is a perspective view of one of the media guide members of the media spindle apparatus of FIG. 1.
Figure 11:
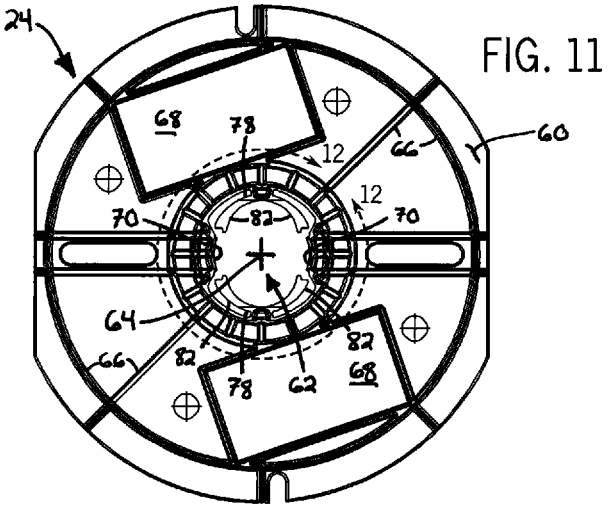
FIG. 11 is a side view of the media guide member of FIG. 10.
Figure 12:
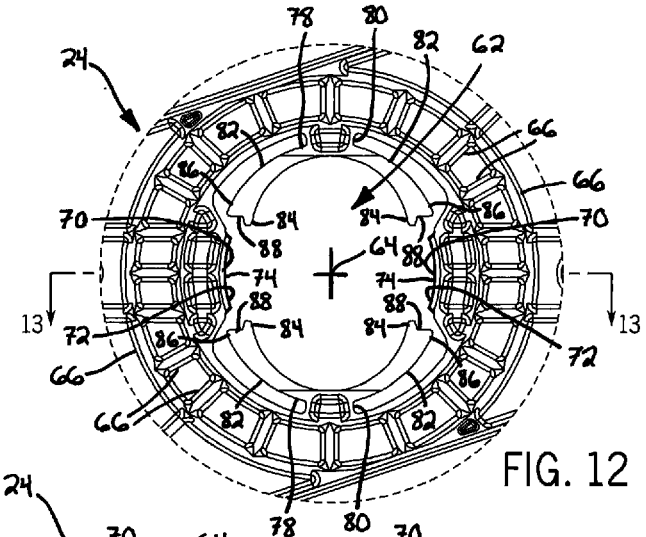
FIG. 12 is a detail view of the portion of the media guide member enclosed by line 12-12 of FIG. 11.
Figure 13:
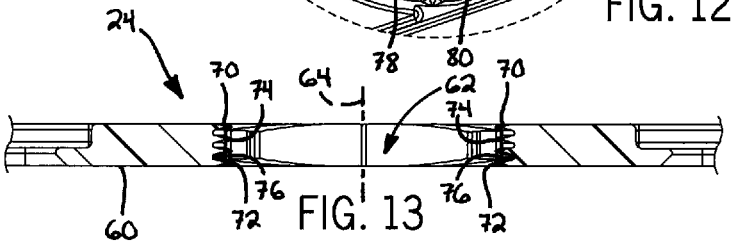
FIG. 13 is a longitudinal sectional view of the media guide member along line 13-13 of FIG. 12.

As illustrated in FIG. 3, the guide members 24 are selectively translatable longitudinally along the spindle 22. As such, media rolls 12 of various axial widths may be installed onto the spindle 22. Thereafter, the guide members 24 may be installed onto the spindle 22 and advantageously translated to appropriate positions adjacent the sides of the media roll 12. As illustrated in FIG. 4 and to inhibit further translation of the guide members 24 relative to the spindle 22, the guide members 24 are selectively rotatable relative to the spindle 22 to engage guide member movement-inhibiting, "locking", or "securing" mechanisms 26 defined by the spindle 22 and the guide members 24. Furthermore, when engaged the securing mechanisms 26 inhibit their own non-destructive disengagement. As such, the securing mechanisms 26 advantageously inhibit non-destructive separation of the guide members 24 from the spindle 22, removal of an exhausted media roll, and installation of incompatible media rolls that could potentially damage the printing apparatus 10. These above components and advantages will be described in further detail below.

The spindle apparatus 20 may be used with various types of printing apparatus 10. For example, the printing apparatus 10 may be the print head of a printer that delivers ink to media to form informational content (e.g., words, letters, numbers, symbols, drawings, and the like) on the media. As another example, the printing apparatus 10 may be the print head of printers that form informational content in other manners, such as embossing or debossing the media and the like. Other types of printers that may use the spindle apparatus 20 will be recognized by those skilled in the art.

Figure 2:
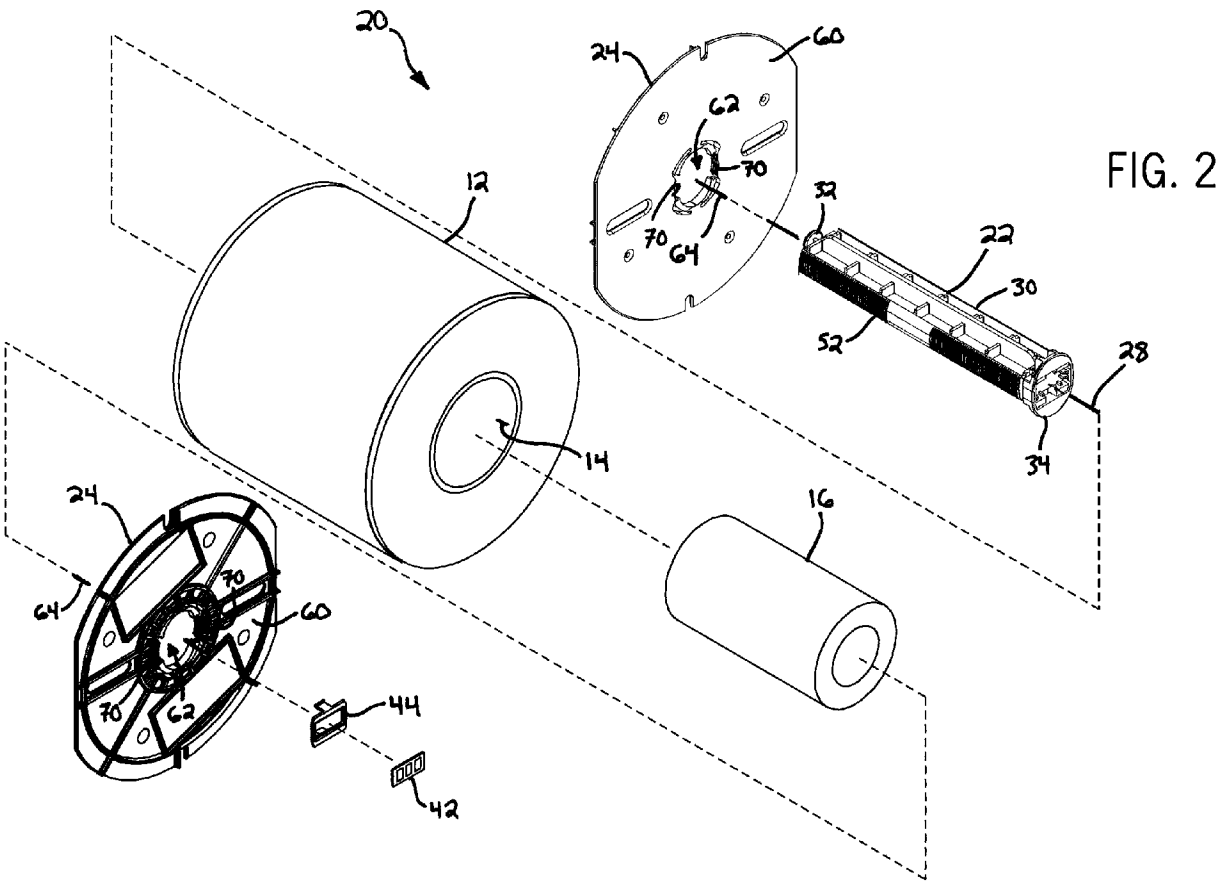
FIG. 2 is an exploded perspective view of the media spindle apparatus and the media roll of FIG. 1 and a spindle adapter.

The media roll 12 may be formed by one or more elongated and wound sheets of various materials, such as ink-receiving paper or adhesive labels supported by one or more releasable liners. Other types of appropriate media materials will be recognized by those skilled in the art. In some embodiments, the media roll 12 includes an inner surface 14 that closely, yet rotatably, fits over the spindle 22. In other embodiments and as shown in FIG. 2, the inner surface 14 of the media roll 12 may be significantly larger than the spindle 22, and a generally cylindrical spindle adapter 16 may be disposed between the spindle 22 and the media roll 12. The spindle adapter 16 may be formed by one or more appropriate materials, such as paper, plastic, or others recognized by those skilled in the art.

Referring now to FIGS. 5-9, the spindle 22 is an elongated component formed by one or more materials, such as plastics. However, in some embodiments other materials, such as paper or metals, may be used. The spindle 22 defines a longitudinal axis 28 that extends along a main body 30 from a first end 32 to a second end 34. The first end 32 projects in the longitudinal direction 28 away from the body 30 and is configured to be detachably supported relative to the printing apparatus 10 (i.e., by a printer). As shown in the figures, an end tab 36 of the first end 32 has an oval shape, although other appropriate shapes will be recognized by those skilled in the art. The second end 34 projects in the longitudinal direction 28 away from the body 30 and opposite the first end 32. The second end 34 is also configured to be detachably supported relative to the printing apparatus, and the second end 34 includes an end tab 38 that may be similar to the first end tab 36. However, the second end tab 38 is larger than the first end tab 36 and includes an axially facing recess 40 (FIG. 5) for receiving an electronic identification component 42 (e.g., a radio frequency identification (RFID) tag) and a cover 44 (see FIG. 2).

Still referring to FIGS. 5-9, the main body 30 of the spindle 22 includes an elongated and longitudinally extending first member 46. The first member 46 integrally connects to a substantially perpendicular and longitudinally extending second member 48 along the longitudinal axis 28 (see FIG. 7) (As used herein, the term "substantially" means within five degrees). A plurality of transversely extending support members 50 also integrally connect to and reinforce the first and second members 46 and 48.

Radially outwardly from the longitudinal axis 28, the first member 46 integrally connects to opposite first engagement features or members 52 of the securing mechanisms 26. Each first engagement member 52 includes a radially outwardly facing surface 54 having a shape that facilitates securing the guide members 24 in the axial direction 28 relative to the spindle 22. In some embodiments and as shown in the figures, the surfaces 54 include a plurality of sine-like shaped teeth or protrusions 56 that define a plurality of sine-like shaped grooves 58 therebetween (see FIGS. 7-9). Each of the protrusions 56 and grooves 58 has an angular length of approximately 60 degrees about the longitudinal axis 28 (see FIG. 7). Furthermore, each of the protrusions 56 and grooves 58 extends in a circumferential direction substantially perpendicular to the longitudinal axis 28 (see FIGS. 8 and 9). As shown most clearly in FIGS. 5 and 6, the protrusions 56 and grooves 58 are omitted from a portion of the spindle 22 that is unlikely to support the guide members 24 (e.g., near the longitudinal middle of the spindle 22). The width and/or position of this portion may be varied, or the entire width of the spindle 22 may include protrusions 56 and grooves 58. In any case, the protrusions 56 and grooves 58 interact with the guide members 24 as described in further detail below.

Referring now to FIGS. 10-13, the guide members 24 are identical components, so only one guide member 24 will be described for simplicity (as used herein, the term "identical" refers to components having the same dimensions within manufacturing tolerances). The guide member 24 includes a main body 60 that defines a central opening 62. The central opening 62 extends through the guide member 24 and receives the spindle 22 along a longitudinal axis 64 that is substantially parallel to the longitudinal axis 28 of the spindle 22.

The main body 60 of the guide member 24 is disposed radially outwardly of the central opening 62. The main body 60 is configured to engage and guide media unwound from the media roll 12. The main body 60 may also include a plurality of radially, circumferentially, and transversely extending ribs 66 for reinforcement. Some of the ribs 66 may also define recesses 68 for receiving labels (not shown) that identify, e.g., the type media supported by the spindle apparatus 20.

The main body 60 of the guide member 24 also integrally connects to components of one of the securing mechanisms 26 at the periphery of and within the central opening 62. In particular, at opposite edges of the central opening 62, the guide member 24 includes second engagement features or members 70 of the securing mechanism 26. Each second engagement member 70 includes a radially inwardly facing surface 72 having a shape that facilitates securing the guide members 24 in the axial direction 28 relative to the spindle 22. In some embodiments and as shown in the figures, the surfaces 72 include a plurality of sine-like shaped teeth or protrusions 74 that define a plurality of sine-like shaped grooves 76 therebetween (see FIG. 13). Each of the protrusions 74 and grooves 76 has an angular length of approximately 40 degrees about the longitudinal axis 64 (see FIG. 12). Furthermore, each of the protrusions 74 and grooves 76 extends substantially circumferentially relative to the longitudinal axis 64 (see FIG. 13). As described in further detail below, the second engagement members 70 are selectively engagable with the first engagement members 52 (i.e., the protrusions 74 are disposable within the grooves 58 and the protrusions 56 are disposable within the grooves 76) to inhibit translation of the guide member 24 in the longitudinal direction 28 relative to the spindle 22.

In addition, the guide member 24 includes two opposite rotation-inhibiting mechanisms 78 disposed angularly between the second engagement features 70. The rotation-inhibiting mechanisms 78 are identical components, so only one mechanism 78 will be described for simplicity. The rotation-inhibiting mechanism 78 includes a shoulder 80 that connects to the main body 60 of the guide member 24. The shoulder 80 integrally connects to two opposite securing arms 82 on opposite transverse sides. Each securing arm 82 is cantilevered within the central opening 62 and extends circumferentially and radially inwardly proceeding away from the shoulder 80. The radial thickness of each securing arm 82 may also increase proceeding away from the shoulder 80, and free ends of each securing arm 82 include a radially inwardly disposed finger 84 and a radially outwardly disposed finger 86 that define a receiving notch 88 therebetween (see FIG. 12).

Figure 14:
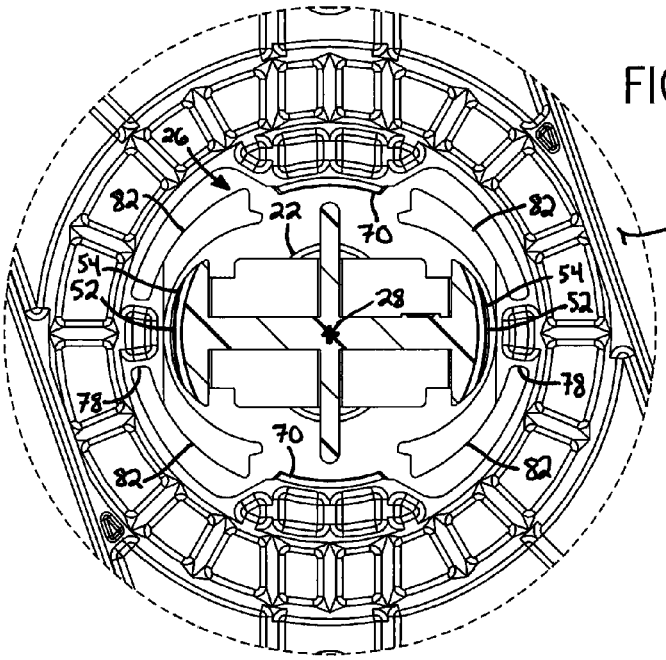
FIG. 14 is a detail cross-sectional view of the media spindle apparatus in the first configuration along line 14-14 of FIG. 3.
Figure 15:
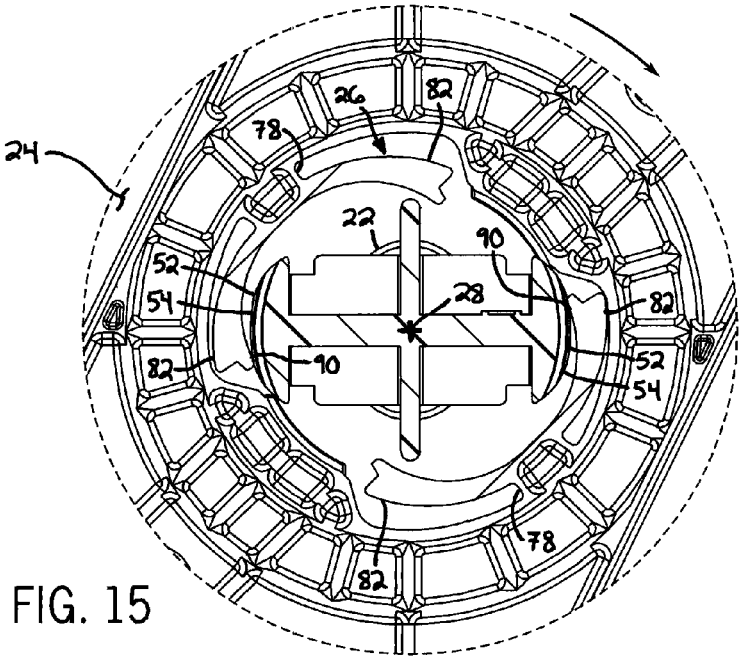
FIG. 15 is a detail cross-sectional view of the media spindle apparatus pivoting from the first configuration to the second configuration.
Figure 16:
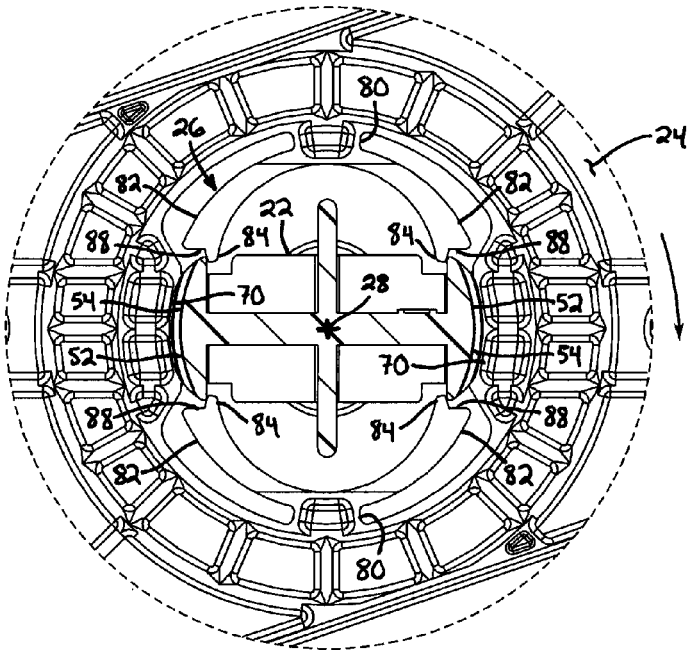
FIG. 16 is a detail cross-sectional view of the media spindle apparatus in the second configuration along line 16-16 of FIG. 4.
Figure 17:
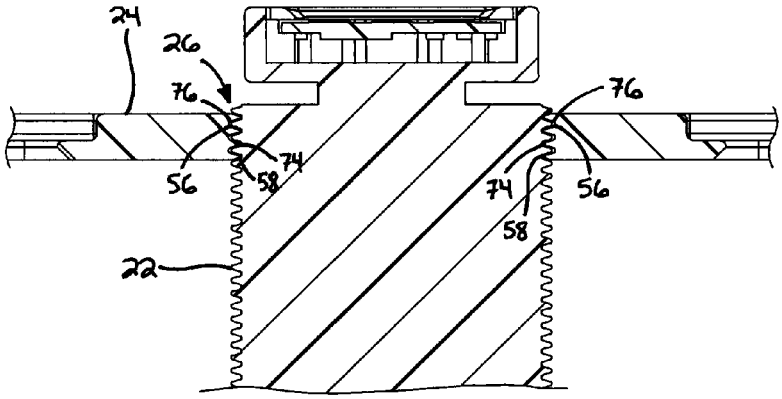
FIG. 17 is a longitudinal sectional view of the media spindle apparatus in the second configuration along line 17-17 of FIG. 4.

Turning now to FIGS. 1 and 14-17, interaction between the guide members 24 and the spindle 22, engagement of the securing mechanism 26, and assembly of the spindle apparatus 20 will now be described in further detail. First, the media roll 12 is positioned on the spindle 22 (in some embodiments, as described above, the spindle adapter 16 is positioned between the media roll 12 and the spindle 22). Next, the guide members 24 are positioned on the opposite ends 32, 34 of the spindle 22. As shown in FIG. 14, the first engagement members 52 are disposed angularly apart from the second engagement members 70. That is, the guide members 24 occupy a "first configuration" in which the guide members 24 are translatable relative to the spindle 22 along the longitudinal axis 28. After translating the guide members 24 to positions proximate the axial sides of the media roll 12, the guide members 24 are pivoted about the longitudinal axis 28 to begin to engage the securing mechanisms 26. When pivoting the guide members 24 and as shown in FIG. 15, an inner surface 90 of one securing arm 82 of each rotation-inhibiting mechanism 78 engages one of the radially outwardly facing surfaces 54 of the spindle 22. As such, each outwardly facing surface 54 applies a bending load to one securing arm 82 to deflect the securing arm 82 radially outwardly. Upon continued pivoting and as shown in FIGS. 16 and 17, the first engagement members 52 engage the second engagement members 70 (i.e., the protrusions 74 are received within the grooves 58 and the protrusions 56 are received within the grooves 76) to inhibit further translation of the guide members 24 relative to the spindle 22. In addition, the deflected securing arms 82 disengage the radially outwardly facing surfaces 54 of the spindle 22 and spring (i.e., move due to elastic deformation) radially inwardly to return to their initial positions. That is, the guide members 24 occupy a "second configuration" in which the securing mechanisms 26 are engaged.

As shown in FIG. 16, in the second configuration each finger 84 of the securing arms 82 engages and is disposed radially inwardly relative to the first engagement members 52. Thus, when attempting to pivot the guide members 24 away from the second configuration, ends of each of the first engagement members 52 move further into the receiving notch 88 of one of the securing arms 82. This applies a substantially compressive load to the securing arms 82 (that is, the securing arms 82 receive a transverse load that generally deflects the fingers 84 toward the shoulders 80). If the load has a sufficient magnitude, the securing arms 82 plastically deform (i.e., crack, fracture into multiple pieces, separate from the shoulders 80, or otherwise lose the ability to elastically return to their initial positions). These characteristics inhibit the guide member 52 from returning to the first configuration without plastically deforming some of the securing arms 82. Thus, the securing mechanisms 26 inhibit reloading the spindle apparatus 20 with subsequent media rolls and reusing the spindle apparatus 20 after the initial media roll 12 is exhausted. Furthermore, plastically deforming some of the securing arms 82 permits component separation and facilitates recycling.

The spindle apparatus 20 may be modified in various other manners that are not explicitly described above. For example, the teeth or protrusions 56, 74 and grooves 58, 76 could have different shapes than those described above, such as rectangular, triangular, spline, or other inverse shapes. As used herein, "inverse shapes" refer to a pair of surface shapes in which both have positive and negative features. Moreover, the positive features of one surface occupy the negative features of the other surface to an extent sufficient to inhibit the surfaces from moving relative to each other in at least one direction without plastic deformation. As another example, one of the guide members 24 could be as described above, and an opposite guide member could be fixedly connected to the spindle 22 or integrally formed as part of the spindle 22. As another example, the securing mechanisms 26 may include different numbers of features and the angle over which the guide members 24 pivot to move from the first configuration to the second configuration may vary. For example, the securing mechanisms 26 could each include four first engagement members 52, four second engagement members 70, and four rotation-inhibiting mechanisms 78, and the guide members 24 could pivot 45 degrees to move from the first configuration to the second configuration. As yet another example, the components of the securing mechanisms 26 could be non-integrally supported by the guide members 24 and the spindle 22.

From the above description, it should be apparent that the present invention provides a size-adjustable spindle apparatus. As such, the spindle apparatus is capable of receiving media rolls of various widths. Furthermore, the spindle apparatus is not reusable with potentially unsuitable media, and destructive removability of the media guides from the spindle facilitates component recycling.

While there has been shown and described what is at present considered the preferred embodiment of the invention, it will be obvious to those skilled in the art that various changes and modifications can be made therein without departing from the scope of the invention defined by the appended claims.

We claim:

1. A media spindle apparatus for supporting a media roll having media to be delivered to a printing apparatus, the media spindle apparatus comprising:

a spindle configured to support the media roll and defining an axial direction about which the media roll is configured to rotate relative to the printing apparatus to deliver the media from the media roll to the printing apparatus;

a guide member supported by the spindle and configured to guide the media from the media roll to the printing apparatus, the guide member supporting a securing mechanism;

wherein the guide member is positionable in a first configuration in which the securing mechanism is disengaged and the guide member is translatable substantially in the axial direction relative to the spindle, the guide member is pivotable about the axial direction relative to the spindle to move to a second configuration and thereby engage the securing mechanism to inhibit the guide member from translating in the axial direction relative to the spindle and pivoting from the second configuration to the first configuration and wherein the securing mechanism includes a first engagement feature supported by the spindle and a second engagement feature supported by the guide member, the first and second engagement features being disposed apart when the guide member is disposed in the first configuration, and the first and second engagement features abutting each other to inhibit the guide member from translating in the longitudinal direction relative to the spindle when the guide member is disposed in the second configuration.

2. The media spindle apparatus of claim 1, wherein the first engagement feature is a first surface of the spindle having a first shape, the second engagement feature is a second surface of the guide member having a second shape, and the second shape is an inverse shape of the first shape.

3. A media spindle apparatus for supporting a media roll having media to be delivered to a printing apparatus, the media spindle apparatus comprising:

a spindle configured to support the media roll and defining an axial direction about which the media roll is configured to rotate relative to the printing apparatus to deliver the media from the media roll to the printing apparatus;

a guide member supported by the spindle and configured to guide the media from the media roll to the printing apparatus, the guide member supporting a securing mechanism;

wherein the guide member is positionable in a first configuration in which the securing mechanism is disengaged and the guide member is translatable substantially in the axial direction relative to the spindle, the guide member is pivotable about the axial direction relative to the spindle to move to a second configuration and thereby engage the securing mechanism to inhibit the guide member from translating in the axial direction relative to the spindle and pivoting from the second configuration to the first configuration and wherein the securing mechanism includes a securing arm that abuts the spindle and elastically deforms when the guide member pivots from the first configuration to the second configuration, and the securing arm abuts the spindle when the guide member is disposed in the second configuration to inhibit the guide member from pivoting to the first configuration without plastically deforming the securing arm.

4. The media spindle apparatus of claim 3, wherein the guide member defines an opening through which the spindle extends substantially in the axial direction, and the securing arm is cantilevered within the opening.

5. A media spindle apparatus for supporting a media roll having media to be delivered to a printing apparatus, the media spindle apparatus comprising:

a spindle configured to support the media roll and defining a longitudinal direction about which the media roll is configured to rotate relative to the printing apparatus to deliver the media from the media roll to the printing apparatus;

a media guide supported by the spindle and configured to guide the media from the media roll to the printing apparatus, the media guide being pivotable substantially about the longitudinal direction relative to the spindle to move from a first configuration to a second configuration, in the first configuration the media guide being translatable substantially in the longitudinal direction relative to the spindle;

a securing mechanism connecting the spindle and the media guide, when the media guide is disposed in the second configuration the securing mechanism inhibiting the media guide from translating in the longitudinal direction relative to the spindle and inhibiting the media guide from pivoting from the second configuration to the first configuration and wherein the securing mechanism includes a first engagement feature supported by the spindle and a second engagement feature supported by the media guide, the first and second engagement features being disposed apart when the media guide is disposed in the first configuration, and the first and second engagement features abutting each other to inhibit the media guide from translating in the longitudinal direction relative to the spindle when the media guide is disposed in the second configuration.

6. The media spindle apparatus of claim 5, wherein the first engagement feature is a first surface of the spindle having a first shape, the second engagement feature is a second surface of the media guide having a second shape, and the second shape is an inverse shape of the first shape.

7. The media spindle apparatus of claim 6, wherein the first shape includes a first plurality of protrusions defining a first plurality of grooves, and the second shape includes a second plurality of protrusions received by the first plurality of grooves and defining a second plurality of grooves receiving the first plurality of protrusions.

8. The media spindle apparatus of claim 7, wherein the first plurality of protrusions, the first plurality of grooves, the second plurality of protrusions, and the second plurality of grooves extend substantially in a circumferential direction relative to the longitudinal direction.

9. The media spindle apparatus of claim 5, wherein a portion of the securing mechanism is supported by the media guide so as to pivot with the media guide relative to the spindle.

10. A media spindle apparatus for supporting a media roll having media to be delivered to a printing apparatus, the media spindle apparatus comprising:

a spindle configured to support the media roll and defining a longitudinal direction about which the media roll is configured to rotate relative to the printing apparatus to deliver the media from the media roll to the printing apparatus;

a media guide supported by the spindle and configured to guide the media from the media roll to the printing apparatus, the media guide being pivotable substantially about the longitudinal direction relative to the spindle to move from a first configuration to a second configuration, in the first configuration the media guide being translatable substantially in the longitudinal direction relative to the spindle;

a securing mechanism connecting the spindle and the media guide, when the media guide is disposed in the second configuration the securing mechanism inhibiting the media guide from translating in the longitudinal direction relative to the spindle and inhibiting the media guide from pivoting from the second configuration to the first configuration and wherein the securing mechanism includes an arm that abuts the spindle when the media guide is disposed in the second configuration to inhibit the media guide from pivoting to the first configuration without plastically deforming the arm.

11. The media spindle apparatus of claim 10, wherein the arm abuts the spindle and elastically deforms when the media guide pivots from the first configuration to the second configuration.

12. A media spindle apparatus for supporting a media roll having media to be delivered to a printing apparatus, the media spindle apparatus comprising:

a spindle configured to support the media roll and defining a longitudinal direction about which the media roll is configured to rotate relative to the printing apparatus to deliver the media from the media roll to the printing apparatus, the spindle including a first engagement surface having a first shape;

a media guide supported by the spindle and configured to guide the media from the media roll to the printing apparatus, the media guide including a second engagement surface having a second shape, the second shape being an inverse shape of the first shape, and the media guide including a securing arm;

wherein the media guide is pivotable substantially about the longitudinal direction relative to the spindle to move from a first configuration to a second configuration, in the first configuration the first engagement surface being disposed apart from the second engagement surface, the media guide being translatable substantially in the longitudinal direction relative to the spindle, and the securing arm being disengaged, and in the second configuration the first engagement surface abutting the second engagement surface to inhibit the media guide from translating in the longitudinal direction relative to the spindle and the securing arm engaging the spindle to inhibit the media guide from pivoting to the first configuration.

13. The media spindle apparatus of claim 12, wherein the media guide includes an opening through which the spindle extends, the second engagement surface is disposed at a periphery of the opening, and the securing arm is cantilevered within the opening.

14. The media spindle apparatus of claim 13, wherein the spindle extends through the opening substantially in the longitudinal direction, and the second engagement surface is angularly disposed apart from the securing arm in a circumferential direction substantially perpendicular to the longitudinal direction.

15. The media spindle apparatus of claim 12, wherein the first shape includes a first plurality of protrusions defining a first plurality of grooves, and the second shape includes a second plurality of protrusions received by the first plurality of grooves and defining a second plurality of grooves receiving the first plurality of protrusions.

16. The media spindle apparatus of claim 12, wherein the securing arm abuts the spindle and elastically deforms when the media guide pivots from the first configuration to the second configuration, and the securing arm abuts the spindle when the media guide is disposed in the second configuration to inhibit the media guide from pivoting to the first configuration without plastically deforming the securing arm.

17. The media spindle apparatus of claim 12, wherein the securing arm abuts an end of the first engagement surface in the second configuration to inhibit the media guide from pivoting to the first configuration.

18. The media spindle apparatus of claim 12, wherein the media guide is a first media guide, and further comprising a second media guide supported by the spindle and identical to the first media guide.

* * * * *